US005765487A

United States Patent [19]

Neff

[11] Patent Number: 5,765,487

[45] Date of Patent: Jun. 16, 1998

[54] PORTABLE TABLE WITH REVERSIBLE CARRYING MEANS

[76] Inventor: Bonnie K. Neff, 714 Seacoast Dr., #105, Imperial Beach, Calif. 91932

[21] Appl. No.: 755,958

[22] Filed: Nov. 25, 1996

[51] Int. Cl.[6] ..... A47B 3/00

[52] U.S. Cl. ..... 108/34; 108/90

[58] Field of Search ..... 108/25, 34, 35, 108/38, 11, 90; 297/17; 190/11, 12 A

[56] References Cited

U.S. PATENT DOCUMENTS

| | | | |
|---|---|---|---|
| 52,196 | 1/1866 | Percheron | 108/34 X |
| 168,402 | 10/1875 | Laumonier | 297/17 X |
| 1,219,790 | 3/1917 | Taylor | 108/90 |
| 2,400,320 | 5/1946 | Trefry | 109/11 |
| 3,034,153 | 5/1962 | Sargent | 108/25 X |
| 3,042,467 | 7/1962 | Germick | 108/25 X |
| 4,122,780 | 10/1978 | Brickman | 108/25 |
| 4,687,248 | 8/1987 | Ross et al. | 297/17 X |
| 5,339,748 | 8/1994 | Bilotti | 108/90 |
| 5,535,683 | 7/1996 | Novak | 108/35 |

*Primary Examiner*—Jose V. Chen
*Attorney, Agent, or Firm*—Brown, Martin, Haller & McClain, LLP

[57] ABSTRACT

A portable table is described, having a top, one or more legs, a reversible sheet secured to the edge of the top and extending, alternately, either upward of downward from the top, with pockets on the outwardly facing side of the sheet when the table is set up and the sheet serves as a table cloth or skirt. When the sheet extends upward from the top, the pockets are one the inside and the sheet is gathered into a bag so that the table, contents of the pockets and other accouterments can be carried by a drawstring threaded through the gathered material or by a handle attached to the table. A retainer ring holds the sheet in place, and may be removed so that the sheet can be removed and cleaned, repaired or replaced. The table finds many uses, including as a beach table, baby tending table, picnic table, informal table, and so forth. It may be made of wood, metal, plastic or hard rubber. It provides a person the ability to carry numerous objects which are to be used in conjunction with the table, such as food or beverage containers, baby supplies, books, writing materials or clothing.

20 Claims, 3 Drawing Sheets

PORTABLE TABLE WITH REVERSIBLE CARRYING MEANS

BACKGROUND OF THE INVENTION

1. Field of the Invention

The invention herein relates to tables. More particularly it relates to portable tables intended to be easily carried to locations such as beaches, stadiums, parks, campgrounds, and the like, and there set up and used for ordinary purposes.

2. Description of the Prior Art

There are many types of small, portable tables. These include card tables, children's tables, coffee tables, TV trays, and the like. One recent addition to the market has been a small picnic-type table which has two small benches integrated with a small table, with the entire assemblage hinged so that it can be folded into a flat package about the size of a folded card table. While all of these are useful for certain tasks, all have serious limitations.

Many of these are relatively flimsy, or are supported on spindly legs, so that they are not well suited for other than the most protected use. A typical example is the card table. Others are simply not readily usable by adults, because of their miniature proportions. A typical example is the foldable picnic-type table, which can seat four children, but which cannot properly accommodate adults. Still others are unduly heavy or of an awkward shape, and cannot be easily transported by one person. Still others are of a shape or structure which cannot be easily used outside, especially in locales such as beaches, woods, campgrounds, parks, stadium parking areas, and the like.

Further, to my knowledge none of the tables now commercial or previously known provides means for carrying or storing the objects which are to be used in conjunction with the table, such as food or beverage containers, baby supplies, books, writing materials, clothing, and so forth. In particular, no known table provides means for transporting such items along with the table itself as a single, unitary package, easily carried by a single person. There is a real need for such a device in the marketplace, but none are known.

SUMMARY OF THE INVENTION

It is the purpose of the present invention to remedy the lack in the marketplace of a table which provides means for carrying or storing the objects which are to be used in conjunction with the table, such as food or beverage containers, baby supplies, books, writing materials, clothing, and so forth, and which also provides means for transporting such items along with the table itself as a single, unitary package, easily carried by a single person. The table of this invention includes the principal elements of a table top, a reversible cloth or plastic sheet material which serves as a table cloth, a bag carrier, a table skirt and a holder for numerous objects and accessories to be used with the table.

In its various embodiments, the portable table of this invention can be used as a beach table, to transport and hold food, food and beverage containers, beach toys, suntan lotion, and other beach-related objects. It can also be used as an informal meal table, for events such as "tailgate" parties in stadium parking lots before or after sports events. Yet other uses include as a portable baby-care table, such as for bathing a baby or changing the baby's diapers, or as a picnic table, either away from the home, as in the woods or a campground, or at home, as on a patio or beside a swimming pool. Of course, numerous other uses will immediately suggest themselves to the person skilled in the art.

Most importantly, the table of this invention includes one or more pockets of various types integrated with or attached to the cloth or plastic sheet material, to contain many different types of objects which will be intended to be used with the table once the site at which it is to be set up is reached. This eliminates the need to have these items transported separately, which is often inconvenient, and which at the least requires either the presence of at least two people to carry the items separately from a table, or requiring one person to make multiple trips to transport everything. With the table of this invention, a single person, such as an adult or teenager, can readily carry not only the table itself but also food, beverages, tools, silverware, cooking utensils, recreation items, or other items desired, as a single package. This package can be held in only one hand, thus leaving the person's other hand free to hold a child's hand, hold onto a railing on a flight of stairs, open or close a vehicle door, etc.

In a broad embodiment, therefore, the invention is of a portable table which can be opened to for use as a table and closed to permit transporting of the table, and which comprises a top having an upper surface, a lower surface and a perimetrical edge; at least one leg removably or foldably attached to the lower surface of the top for support of the table when the table is opened; a reversible sheet secured to the top along the perimetrical edge and extending from, alternately, the upper and the lower surfaces; the reversible sheet having at least one closable pocket disposed on the side thereof which faces outwardly when the sheet extends from the lower surface, the side becoming the inwardly facing side of the sheet when the sheet extends from the upper surface; the closable pocket comprising sheet material mounted on the side of the reversible sheet to form a chamber defined by the reversible sheet and the sheet material, the chamber having first and second closable openings respectively at the ends of the pocket disposed toward and away from the top; the sheet having sufficient extended length from the top to be gatherable into a closable bag-like configuration when extended from the upper surface and releasably secured in such configuration when the table is closed; and carrying means for carrying the table when closed.

The carrying means may be a drawstring which gathers the sheet into the bag-like configuration, or it may be a handle mounted on the table, preferably on a retainer ring used to secure the sheet to the table top. Such a handle preferably cooperates with a hook mounted on the drawstring, so that when the drawstring is pulled to close the "bag," the hook can engage the handle and retain the drawstring in its pulled position closing the "bag."

In other, more specific embodiments, there may be a plurality of pockets; some or all of the pockets may be sewn shut at one end and openable and closable at the other, or openable and closable at both ends; the sheet may extend across the upper surface of the top, in the manner of a table cloth; there may be more than one leg (preferably there will be three); and/or the legs may be detachable, telescoping or foldable.

DETAILED DESCRIPTION AND PREFERRED EMBODIMENTS

Figure 4:
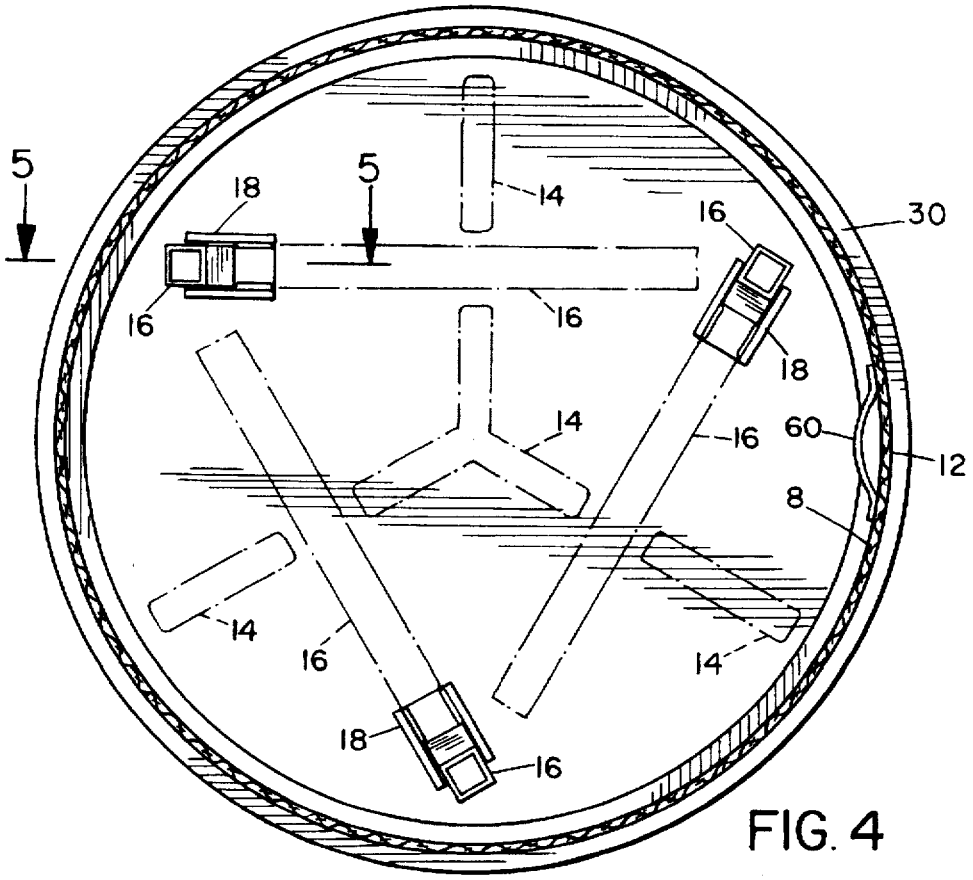
FIG. 4 is a bottom plan view of the table of FIG. 1 with a portion of the skirt cut away.
Figure 5:
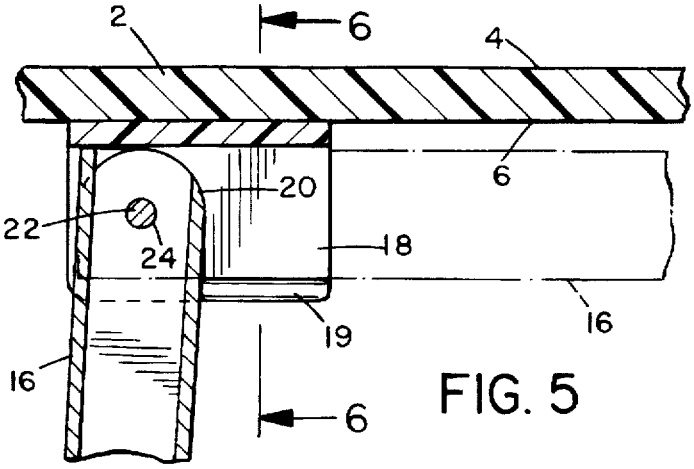
FIG. 5 is an enlarged sectional view taken on Line 5—5 of FIG. 4.
Figure 6:
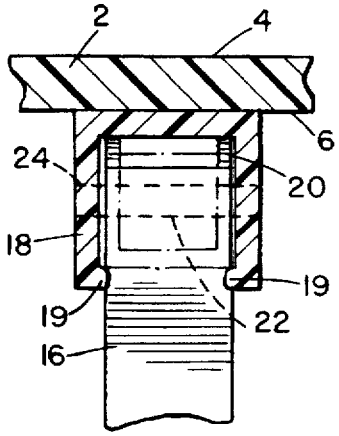
FIG. 6 is a sectional view taken on Line 6—6 of FIG. 5.

The present invention is best understood by reference to the drawings. The table 10 is formed of a top 2 which has an upper surface 4 and a lower surface 6, and which is bounded by a peripheral edge 8. The top 2 may be made from a variety of different materials, including but not limited to wood, plastics (polymeric resin materials), hard rubber or metal. Thermosetting resin materials, hard rubber compositions or non-ferrous metals are preferred, because of their resistance to adverse effects of exposure to heat, cold, sun, wind, water, salt spray or other weather or environmental elements, and because they can easily be washed or wiped clean. Suitable plastics include phenolics, acrylonitrile-butadiene-styrene (ABS) resins, polycarbonates, polyvinyl chlorides, acrylic and methacrylic resins, epoxies, and similar polymeric materials, which may also contain fibrous reinforcement, such as glass or carbon fibers. Aluminum alloys are the preferred metals; they are inexpensive, readily available, easily worked in manufacturing and light weight. Aluminum table components may be anodized to enhance weather resistance. Other metals such as brass and stainless steel may also be used. Woods can be used, but most are not preferred since they deteriorate rapidly when exposed to the elements, unless they are protected by being coated or impregnated with sealers, lacquers, varnishes or other weather-resistance materials. The table top 2 may be of any convenient shape, but circular (as shown) is preferred. A circular table not only makes application and use of the cloth or plastic sheet 12 easier, but also being without corners, it is less susceptible to damage and easier to carry. Those shapes which are substantially different from circular (e.g., square, rectangular, elongated oval) are less preferred than are the shapes which more closely approximate circular (e.g., short oval or ellipse, octagonal). The dimensions of the top 2 will be selected to insure that the table is reasonably portable, while yet having sufficient surface area to be useful. I have found that a diameter in the range of 16"–24" (41–61 cm) is quite satisfactory, although of course larger or smaller sizes may occasionally be used. The top thickness will be such as to have sufficient strength to support the weight of food, books, beverages, coolers, etc., which may be placed on it, but not so thick that its own weight becomes a limitation on use or portability of the table. I have found that for a wood table top, a thickness in the range of ¾"–1¼" (19–31 mm) is quite satisfactory. Metal tops may be thinner, and plastic or hard rubber tops may be thicker, to obtain the appropriate strength-to-weight properties. Thinner tops may also be stiffened against flexure by one or more ribs 14 (shown in phantom in FIG. 4) mounted on or molded into the lower surface 6. Such ribs 14 must, of course, not interfere with the operation of the legs 16. Suitable top materials, top shapes and configuration for any desired purpose will be evident to those skilled in the art.

Mounted on the lower surface 6 of top 2 are retractable or foldable legs 16. In the preferred embodiment, legs 16 fold down against lower surface 4 when not in use. This can be accomplished by means of hinges 18, which are attached (by conventional fasteners or adhesives, not shown) to lower surface 6 and in each of which the proximal end 20 of a leg 16 is pivotally mounted using hinge pin 22. It is preferred that the fit of the hinge pin 22 in the corresponding hole 24 in the proximal end 20 of leg 16 be moderately tight, but still permitting movement under a reasonable urging force (i.e., hand pulling by a person of ordinary strength) so that the legs 16 will not wobble. The legs 16 are locked in place (either extended or folded) by projections 19 on hinge 18. A three-legged configuration is preferred, to allow the table 10 to be used on irregular surfaces. However, other leg configurations are also contemplated for specific uses. For instance, a table with one centered leg can be used with a separate mounting stand, such as those used for large umbrellas, or the single leg can be secured in a hole in the ground, beach sand, etc. Similarly, a four-legged table can be used on flat surfaces, such as a patio, pool deck or stadium parking lot, or where irregularities in the surface can be smoothed out, such as with beach sand, or if the legs have a length adjustment to accommodate irregular surfaces..

The length of the legs will be dependent upon the intended use of the table. Tables intended for beach use may have relatively short legs, since they will be use by people sitting on blankets to towels or in low beach chairs. Tables intended for use on patios, in campgrounds or a tailgate parties will usually have longer legs, since they will be used more often by people standing or sitting on regular height chairs. Advantageously the legs may be made in sections so that they telescope to the desire height (with conventional means to hold them in the desired position) or hinge pins 22 may be removable and reinsertable so that legs 16 of different lengths may be alternately attached to the table.

The legs 16 will normally be made of the same material as the table top 2 for ease of manufacture. However, the legs 16 may be of a different material than the top 2 if desired. For example, if it is contemplated that the lower parts of the legs will become wet in use, as with a beach table, such legs may be made of a more water-resistant material than is the top. Further, it is contemplated that legs of different materials may be interchangeable, in the same manner as discussed above for interchange of legs of different lengths, with the particular type of leg chosen for the particular use planned.

The flexible sheet material 12 which can be considered to be a skirt, bag or table cloth, depending upon its specific deployment at any time, is cut so that an extensive width W is present. Using the preferred circular configuration of the table top 2 as an example, as shown in the drawings, the sheet material 12 in the simplest embodiment will be a rectangular strip of material with the width W and a length slightly greater than the circumference of the top 2 at the edge 8. The slight excess of material in the length is to allow the two ends on the strip to be joined at seam 26. Seam 26 may be formed by any conventional means, including but not limited to stitching, adhesive bonding or thermal bonding.

Again in the simplest configuration, one edge portion 28 of the material 12 is in contact with and encircles edge 8. Preferable there is full contact of the edge portion 28 with the edge 8, to insure retention of the material 12 in place. On the outside of the edge portion 28 and concentric with edge 8 is retainer ring 30. Retainer ring 30 has a shape conforming to the shape of edge 8 and is sized such that it can be force fitted over the portion 28 of material 12. The force fit creates a frictional restraint between edge 8, ring 30 and portion 28 such that the portion 28 is securely locked into position and the material 12 is secured to the table top 2. Retainer ring 30 may be a heavy elastic band, webbing or a similar type of belting material, with a suitable buckle (not shown), a closable split metal ring, a plastic hoop or the like. However, whatever ring material is chosen, the securing fit must be sufficiently strong to permit inversion of the sheet material 12 (as will be discussed below) but still be releasably when desired, to enable the sheet material to be removed from time to time for cleaning, repair or replacement.

In another embodiment (indicated in phantom in FIG. 3), the sheet material continues across the upper surface 4 of the top 2, to serve as a table cloth.

Figure 2:
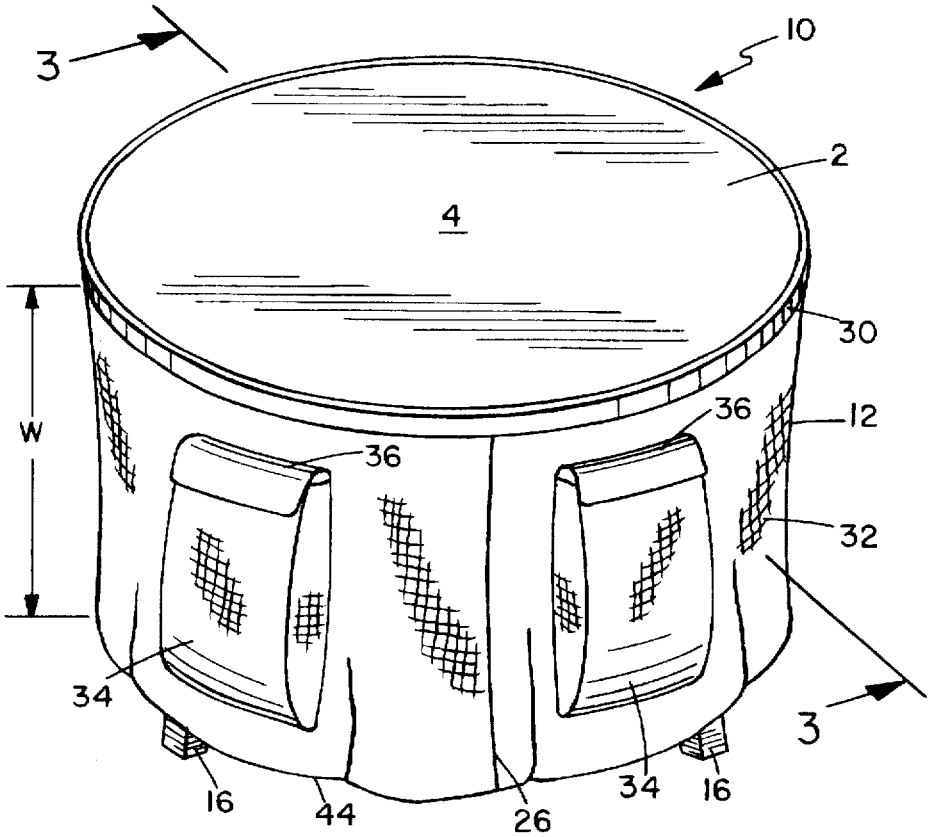
FIG. 2 is a perspective view of the table of FIG. 1 opened and set up for use, including illustration of one embodiment of pockets.
Figure 7:
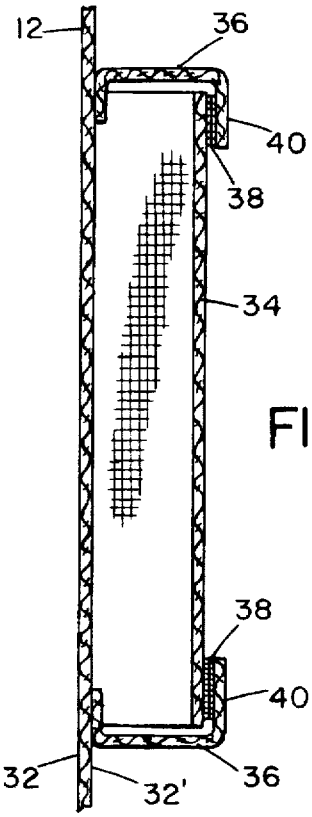
FIG. 7 is an enlargement similar to a portion of FIG. 3, but showing an embodiment with a pocket opening at both ends.
Figure 8:
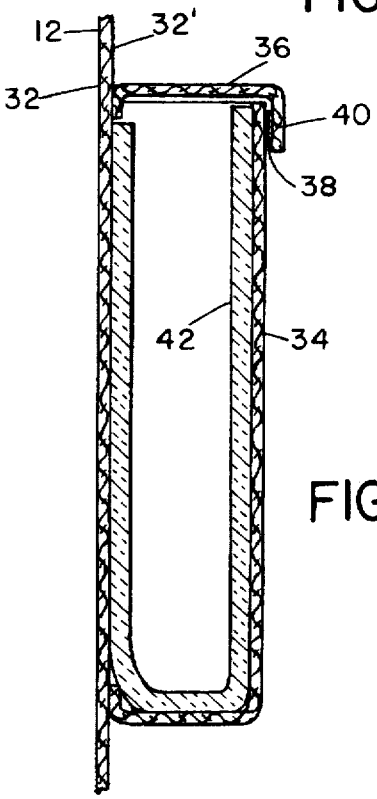
FIG. 8 is a view similar to that of FIG. 7 but showing an insulated pocket.

On the outer side 32 of sheet 12, when it forms a skirt around the table 10 as shown in FIG. 2, are one or more pockets 34. Pockets 34 may be attached to or molded into the side 32 by any conventional means, including riveting, stitching, adhesive boding or heat bonding. Each pocket 34 will be closed on all sides, each will have at least one openable closure 36 to enable one to place items in the pocket and retrieve them when desired. Usually the closure 36 will be a simple flap 40 which is maintained in a closed position by a button, snap, hook-and-loop fastener (e.g. Velcro™ material) or similar fastener 38. As shown in FIGS. 2, 7 and 8, each pocket 34 may have one flap or other type of closure, thus have only one end openable, or it may have another flap or closure 40' at the opposite end, to facilitate insertion or removal of items which would be difficult or awkward to insert or remove with only one flap 40. It is also contemplated that any or all of the pockets 34 may be lined with an insulating material 42, to maintain hot or cold items at their desired temperatures for an extended period. Suitable thermal insulation materials are well known and readily available.

The sheet material may be a conventional cloth, rubber or polymeric fabric, including various types of plastic or polymeric materials. Typical examples of suitable fabrics include vinyls, nylons, polyethylenes, polyesters (e.g., Mylar™ films), polypropylenes, cotton, sailcloths, synthetic leather-like materials, glass fiber cloths or blended fiber fabrics. The fabric chosen must be such as to withstand the adverse effects of the elements, as well as abrasion, liquid and food spills, dirt and the like. Preferably the fabric will be colored or provided with a pleasing pattern on the surface, to enhance the appearance of the table. The pockets may be of different material, but preferably will be of the same material to simplify manufacturing, insure compatibility and minimize cost. The pockets may be colored or patterned in the same manner as the sheet 12. It would also be possible to have the pockets 34 of different colors or patterns from the sheet 12, and even from each other, also to enhance appearance or to provide for easy identification of which pocket a particular item has been stored in.

Figure 1:
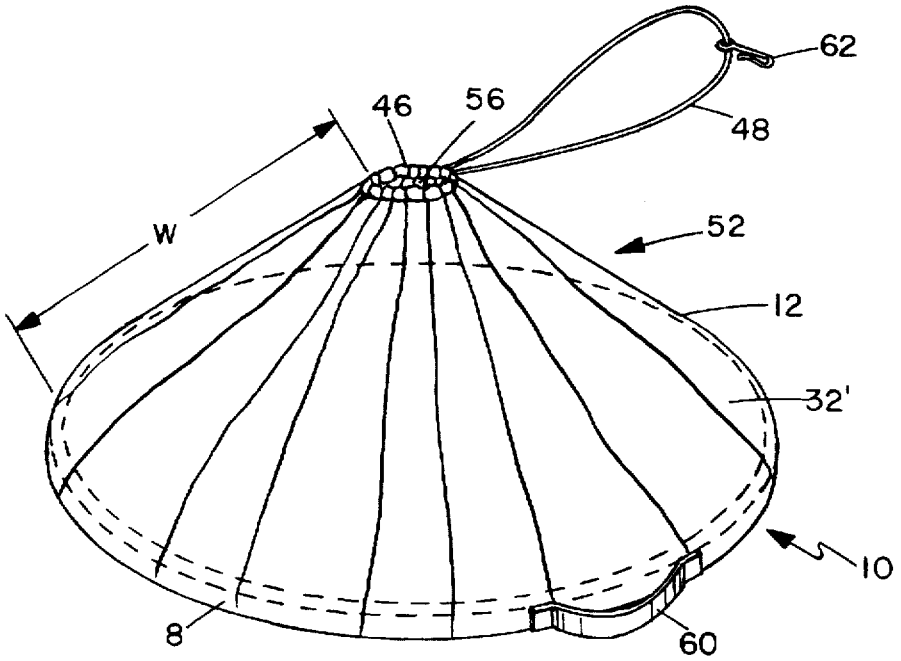
FIG. 1 is a perspective view of a portable table of this invention in a closed configuration for being carried.
Figure 9:
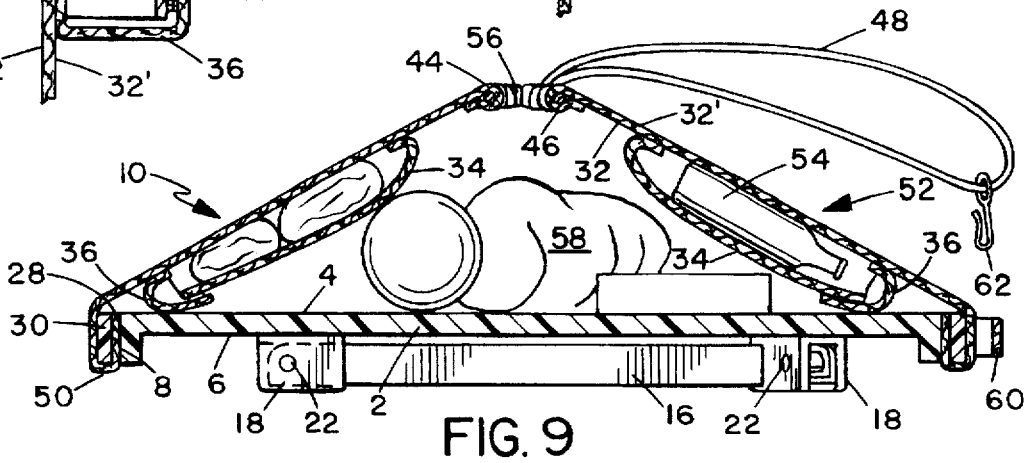
FIG. 9 is a view similar to that of FIG. 2, but showing the legs folded and the skirt closed into a bag configuration.

The distal edge 44 of sheet 12 is formed into a conduit 46 through which a drawstring 48 runs. When the table 10 is to be moved, the sheet material 12 is inverted so that what was the "skirt" shown in FIGS. 2 and 3 now becomes a "bag" 52 as shown in FIGS. 1 and 9. It will be seen that the respective surfaces 32 and 32' of the material 12 now reverse, so that surface 32' is the outer surface and surface 32 is the inner surface of the bag configuration. The pockets 34 also now are positioned on the inside of the bag 52, as best seen in FIG. 9. Of course, this means that the contents of each pocket are also inverted, so that attention must be paid to insuring that containers such as bottle 54 within the pockets are securely closed.

Figure 3:
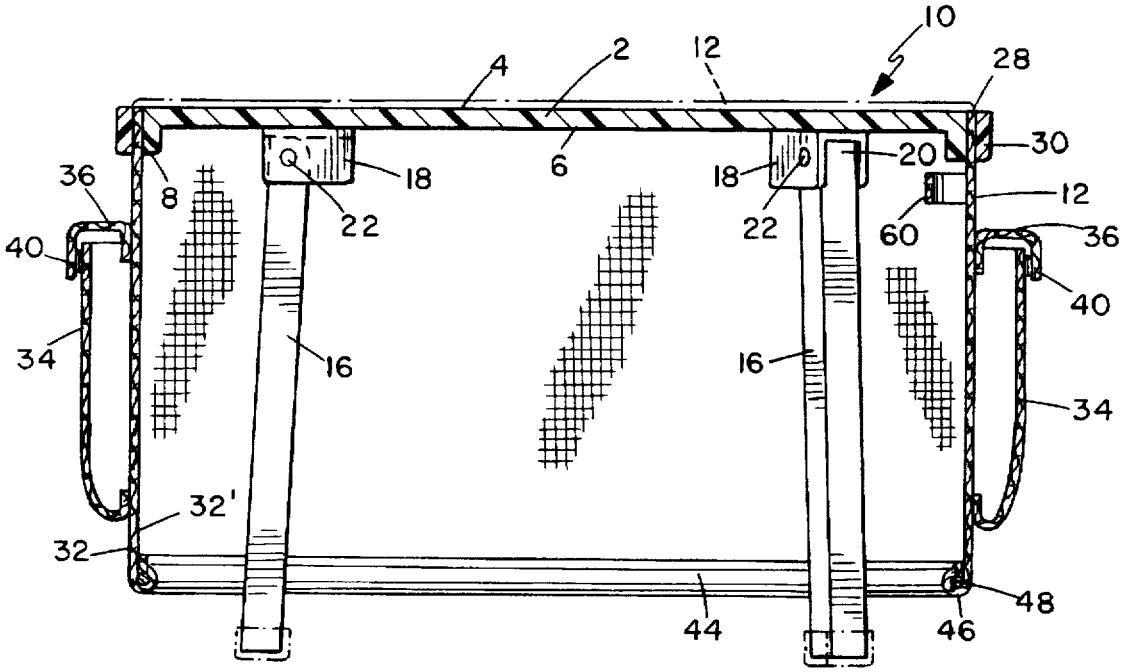
FIG. 3 is an enlarged sectional view taken on Line 3—3 of FIG. 2.

When the sheet 12 is inverted, the edge portion 28 remains secured in position inside ring 30, as seen in FIG. 9. However, the adjacent portion 50 of the sheet 12 now wraps around the bottom and outer side of ring 30, again as seen in FIG. 9, and then the remainder of sheet 12 extends upward over upper surface 4 of the top 2. The drawstring 48 is then pulled so that the edge 44 and conduit 46 are gathered into a small diameter circular opening 56, effectively closing the "bag" 52. This allows the table to be carried by the drawstring 48, along with all of the contents of the pockets. The dimension W must therefore be selected such that a skirt of reasonable length will be formed when the table is opened, as illustrated in FIGS. 2 and 3, and that also a bag of reasonable size will be formed when the sheet material 12 is inverted. The opening 56 need not be minute, but should be able to be drawn small enough that larger loose items, such as shown at 58, can be retained in the bag configuration when the table is carried.

It will be convenient to include a handle 60 mounted on the outside of the retainer ring 30, to facilitate carrying the table to and from the location at which it is to be set up. Since the top 2 will be oriented vertically when the table is carried by handle 60, the "bag" 52 must be secured so that items 58 inside and those items in the pockets will not fall out. One could secure "bag" 52 by pulling on the drawstring 48 until the opening 56 is substantially closed, and then tying a knot in the drawstring 48 to prevent it from loosening. However, repeatedly tying knots in the drawstring will ultimately damage the drawstring and probably also the fabric surrounding opening 56. In addition, if the drawstring gets wet, as is likely for instance at the beach, a tied knot can become very difficult to untie. It is therefore preferred to attach a sliding hook 62 to the drawstring 48. When the drawstring 48 is pulled to close the opening 56, the hook 62 can be engaged with the handle 60 so that the drawstring 48 cannot loosen while the table is being carried. When it is desired to set up the table for use, the hook 62 can be disengaged from the handle 60 and the drawstring 48 loosened to open opening 56 and put the table into use as described above. The hook 62 then slides to a free part of the drawstring 48 and is out of the way until use of the table is finished and the "bag" 52 is again to be closed and the table carried by handle 60.

The tables of the present invention find use in many places and with many different types of activities engaged in by people. These tables are extremely versatile, and can be easily reconfigured for different activities, merely by changing leg length or sheet material size or width, an ability not found in prior art portable tables. The ability of the tables to be readily disassembled and cleaned or stored also in a significant advantage, as compared to prior art portable tables.

It will be evident that there are numerous embodiments of this invention which, while not expressly described above, are clearly within the scope and spirit of the invention. The above description is therefore intended to be exemplary only, and the actual scope of the invention is to be determined solely from the appended claims.

I claim:

1. A portable table which can be opened to for use as a table and closed to permit transporting of said table, and which comprises:

a top having an upper surface, a lower surface and a perimetrical edge;

at least one leg removably or foldably attached to said lower surface of said top for support of said table when said table is opened;

a reversible sheet secured to said top along substantially all of said perimetrical edge and extending therefore, alternately, in the direction of said upper and said lower surfaces;

said reversible sheet having at least one closable pocket disposed on the side thereof which faces outwardly when said sheet extends from said lower surface, said side becoming the inwardly facing side of said sheet when said sheet extends from said upper surface;

said closable pocket comprising sheet material mounted on said side of said reversible sheet to form a chamber defined by said reversible sheet and said sheet material, said chamber having first and second closable openings respectively at the ends of said pocket disposed toward and away from said top each of said openings comprising securing means for closing said openings;

said sheet having sufficient extended length from said top to be gatherable into a closable generally compacted bag-like configuration when extended from said upper surface and releasably secured in such configuration when said table is closed; and carrying means for carrying said table when closed.

2. A portable table as in claim 1, further comprising a drawstring channel formed substantially along the entire end of said sheet distal from said top and including an opening providing access to the interior thereof, and a drawstring disposed in said channel, the ends of said drawstring extending out of said channel through said opening, whereby said gathering of material is accomplished by pulling said ends of said drawstring to shorten the length of said drawstring within said channel, thereby causing the sheet at said distal end to gather and form a closed bag-like configuration.

3. A portable table as in claim 2 wherein said carrying means comprises said drawstring when said sheet is gathered in said closed bag-like configuration.

4. A portable table as in claim 1 wherein said first closable opening of said closable pocket is openably closable and said second closable opening of said closable pocket is fixedly closed.

5. A portable table as in claim 1 wherein both of said closable openings of said closable pocket are openably closable.

6. A portable table as in claim 1 further comprising fastener means for openable securement of said closable openings, said fastener means comprising a button, a zipper, a snap or a hook-and-loop material.

7. A portable table as in claim 1 further comprising a plurality of said closable pockets disposed on said sheet.

8. A portable table as in claim 1 further comprising securing means for securing said sheet to said edge of said top.

9. A portable table as in claim 8 wherein said carrying means comprises a handle disposed on said securing means.

10. A portable table as in claim 9 wherein said handle further cooperates in maintaining secured closure of said bag-like configuration of said sheet when said table is closed.

11. A portable table as in claim 8 wherein said securing means comprises a retainer ring circumscribing said perimetrical edge and fitting closely thereto, whereby said sheet can be secured to said edge by being frictionally retained between said edge and the inner surface of said ring when said ring is fitted over said edge.

12. A portable table as in claim 11 wherein said retainer ring is formed of an elastic band, webbing, belting material, metal or plastic.

13. A portable table as in claim 1 wherein said sheet further extends across said upper surface of said top.

14. A portable table as in claim 1 wherein said at least one leg is foldably mounted to said lower side of said top.

15. A portable table as in claim 14 comprising a plurality of legs foldably mounted to said lower side of said top.

16. A portable table as in claim 15 comprising three support legs.

17. A portable table as in claim 1 further comprising locking means for locking said at least one leg in, alternately, a folded and an opened position.

18. A portable table as in claim 1 wherein said top is formed of plastic, metal, wood or hard rubber.

19. A portable table as in claim 18 wherein said at least one leg is formed of the same material as said top.

20. A portable table as in claim 1 further comprising at least one rib integrated with said table top for stiffening said top against flexure.

* * * * *